US005704801A

United States Patent [19]

Walker et al.

[11] Patent Number: 5,704,801

[45] Date of Patent: Jan. 6, 1998

[54] POWER CABLE TAP CONNECTOR

[75] Inventors: Robert Wayne Walker, Harrisburg, Pa.; Michael Kenneth Dixon, Stuart, Fla.

[73] Assignee: The Whitaker Corporation, Wilmington, Del.

[21] Appl. No.: 707,039

[22] Filed: Aug. 30, 1996

[51] Int. Cl.[6] ..... H01R 4/26

[52] U.S. Cl. ..... 439/417

[58] Field of Search ..... 439/417, 409, 439/412, 413, 725, 863, 405, 404, 395

[56] References Cited

U.S. PATENT DOCUMENTS

| | | | |
|---|---|---|---|
| 2,627,537 | 2/1953 | Weisberg | 439/409 |
| 3,877,774 | 4/1975 | Dorrell | 439/409 |
| 3,976,351 | 8/1976 | Hopfe | 439/409 |
| 4,080,034 | 3/1978 | Werner | 339/98 |
| 4,427,253 | 1/1984 | Smith et al. | 339/98 |
| 4,478,471 | 10/1984 | Olsson | 339/74 R |
| 4,764,125 | 8/1988 | Debortoli | 439/403 |
| 4,767,354 | 8/1988 | Saligny | 439/413 |
| 4,789,352 | 12/1988 | Kreinberg et al. | 439/260 |
| 4,984,383 | 1/1991 | Mummey et al. | 439/259 |
| 5,006,077 | 4/1991 | Loose et al. | 439/409 |
| 5,007,858 | 4/1991 | Daly et al. | 439/498 |
| 5,139,440 | 8/1992 | Volk et al. | 439/413 |
| 5,154,633 | 10/1992 | Lee | 439/409 |
| 5,186,648 | 2/1993 | Senra | 439/409 |
| 5,302,144 | 4/1994 | Francois et al. | 439/781 |
| 5,453,022 | 9/1995 | Staiger et al. | 439/404 |
| 5,637,011 | 6/1997 | Meyerhoefer et al. | 439/417 |

OTHER PUBLICATIONS

*AMP Catalog* 85-766, "CR Connector Systems Zero Insertion Force," (Rev. Feb. 1990); pp. 1-7, 18-21; AMP Incorporated, Harrisburg, PA.

*Primary Examiner*—Gary F. Paumen
*Assistant Examiner*—Tho Dac Ta
*Attorney, Agent, or Firm*—Anton P. Ness

[57] ABSTRACT

Connector (10) terminatable to a power cable (12) for tapping thereof, and having a housing (20), a clamp member (40) and an actuator (80) all linked by fasteners (100) when assembled around a length of the cable (12). Actuation of the actuator (80) urges the housing (20) toward and against the clamp member (40) with cable (12) nestled in a channel therebetween defined by grooves (30,44). IDC contacts (22) of the housing (20) extend toward cable (12) within groove (30) and establish terminations with respective conductors (14) of the power cable upon termination. The actuator (80) is cradled between slotted arms (48) of the clamp member and includes a cam (82) bearing against the clamp member when actuated to move the actuator away from the clamp member, with links (100) carried thereby and in turn pulling the housing against the clamp member.

16 Claims, 4 Drawing Sheets

POWER CABLE TAP CONNECTOR

FIELD OF THE INVENTION

The present invention relates to the field of electrical connectors and more particularly to connectors for establishing a tap connection to power cable.

BACKGROUND OF THE INVENTION

For establishing taps to cables having a plurality of conductors for transmission of electrical power, it is desired to provide a connector that is easily appliable to the cable with only standard tools, at a midpoint of the cable.

It is further desired to provide a connector that may be applied after the cable has been routed through a premises.

SUMMARY OF THE INVENTION

The present invention provides a connector terminatable to a cable at any selected location along the cable length, for tapping. The connector includes a plurality of insulation displacement connection (IDC) contacts within an insulative housing member, and a second member complementary to the housing member to define a cable-receiving groove therebetween such that the IDC sections of the contacts extend into the groove. An actuation system is provided that through application of standard tools such as a wrench, urge the members toward and against each other about the cable to press the insulated cable onto the IDC contact sections with enough force to move the IDC sections into the cable insulation. IDC slots receive the discrete conductors thereinto while penetrating the insulation about the individual conductors to establish a compressive electrical connection with the conductors, all without removing the insulation from the conductors or even removing the outer cable jacket.

The actuator system includes an elongate cam member extending across a remote surface of the second member with ends extending beyond side edges thereof, and having cylindrical portions adjacent to the ends nestled in slots of bifurcated side walls. Link members are affixable to lugs of both the housing member and the ends of the elongate cam. Upon actuation of the cam such as by rotation thereof, the eccentric surface of the cam bears against the remote surface of the second member to move the cam ends relatively upwardly in the slots thus pulling the links upwardly. As a result, the housing member is pulled against the second member forcing the cable onto the IDC contact sections with enough force that the pointed beams to either side of each IDC slot penetrate the cable outer jacket on either side of each conductor therewithin, eventually establishing electrical connections with the conductors.

A detent in the remote surface retains the cam in a fully actuated position, securing the connector assembly to the cable. Preferably the second member is mountable to a wall or other structure, and the housing member defines a mating face for mating with a complementary connector.

An embodiment of the present invention will now be described by example with reference to the accompanying drawings.

DETAILED DESCRIPTION

Figure 1:
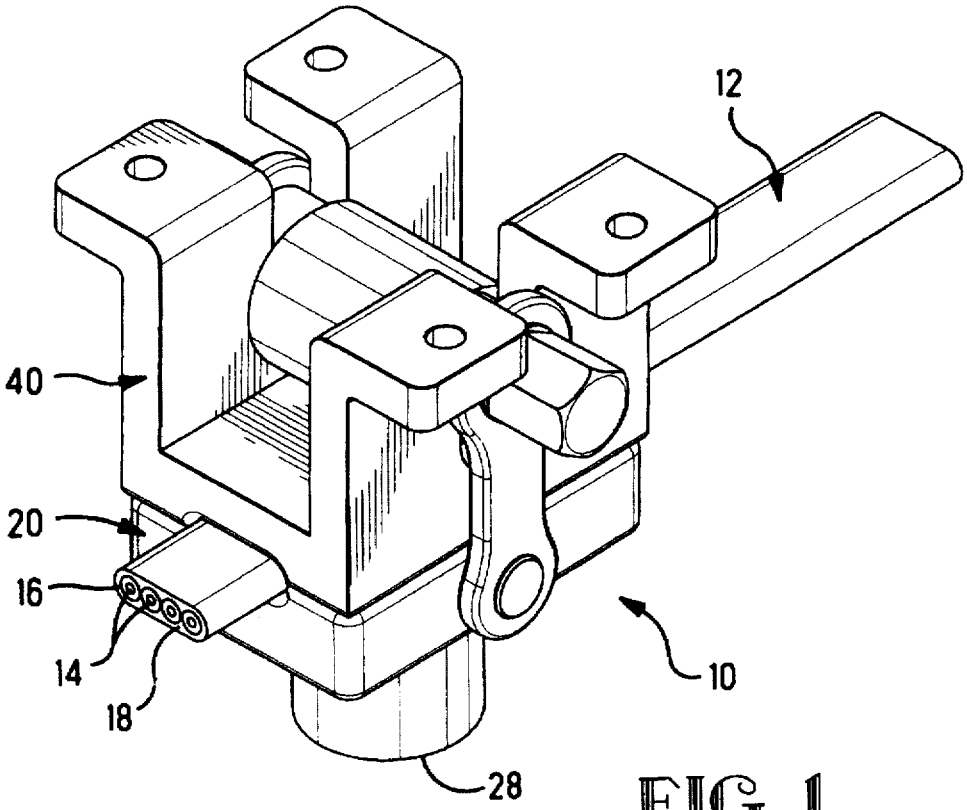
FIGS. 1 and 2 are isometric views of the connector of the present invention after and prior termination to a cable, respectively.
Figure 2:
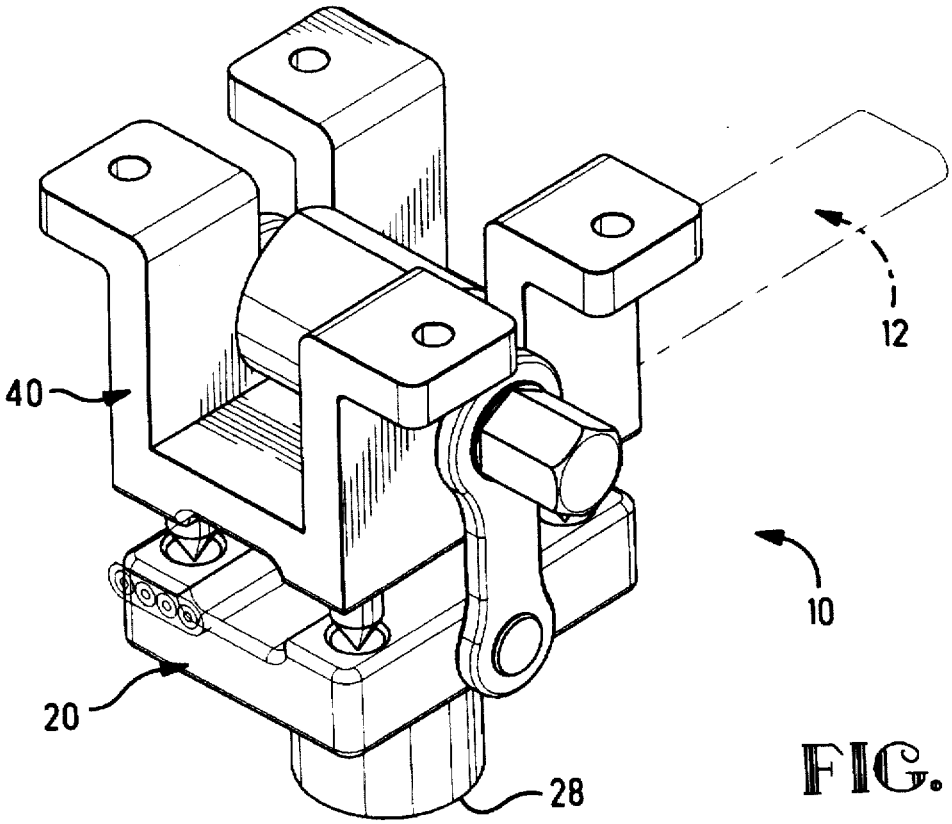
Figure 3:
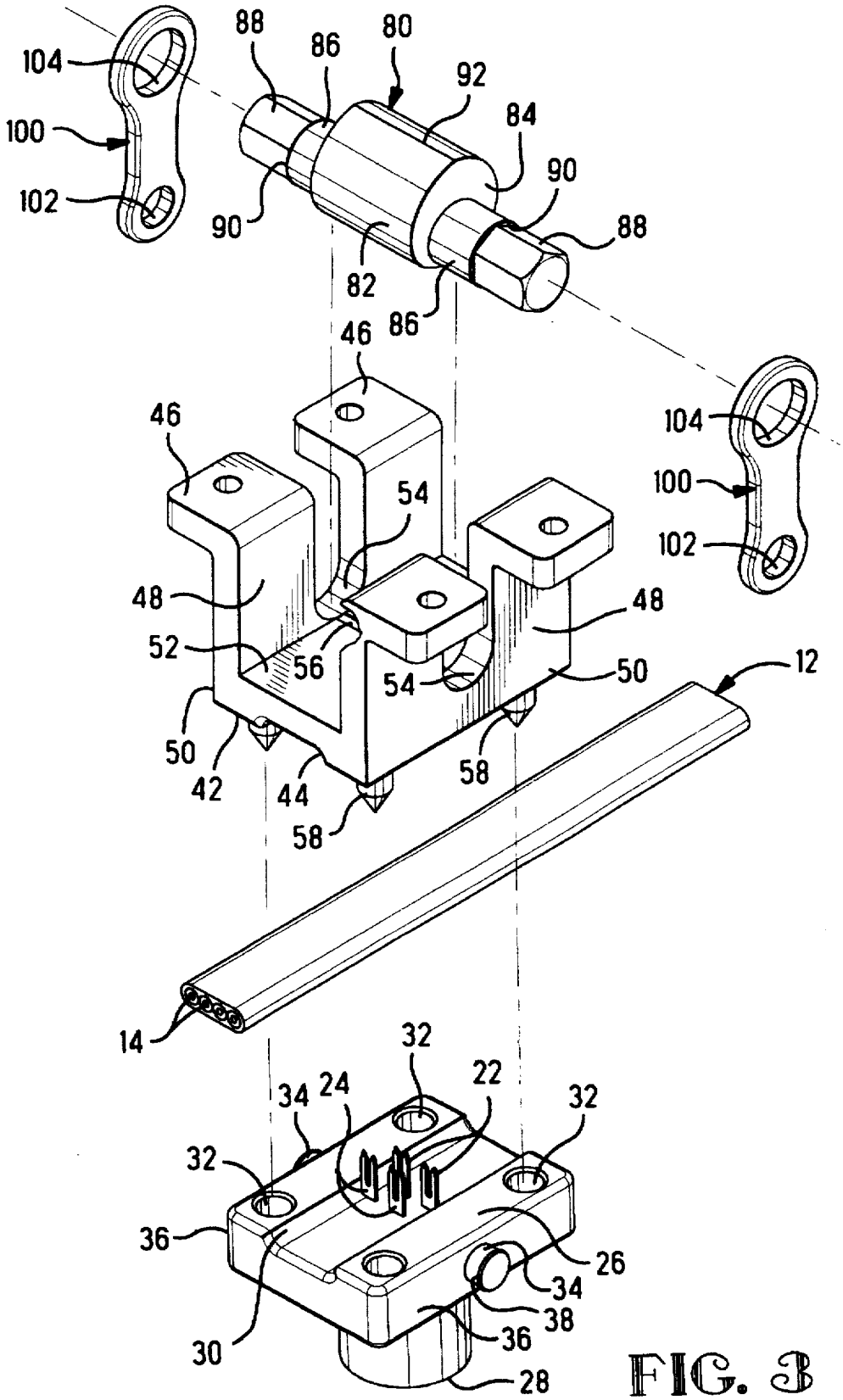
FIG. 3 is an exploded isometric view of FIG. 1.

Connector 10 of the present invention is useful in forming a tap connection by being terminated to multiconductor cable such as power cable 12 having a plurality of conductors 14 each of which is individually insulated by inner jacket 16, all within an outer jacket 18, referring initially to FIGS. 1 to 3, with cable 12 in phantom in FIG. 2. Connector 10 includes an insulative housing 20 within which are mounted a plurality of contacts 22 each having an IDC contact section 24 extending upwardly from a cable-proximate face 26 of housing 20; contacts 22 also include opposed contact sections (not shown) exposed along a mating face 28 of housing 20 for mating with complementary contacts of a mating connector (not shown) and that preferably are recessed within apertures of the housing at the mating face for safety concerns. Preferably, housing 20 includes a cable-receiving groove 30 along cable-proximate face 26 within which cable 12 will be seated upon termination.

Connector 10 further includes a clamp member 40 preferably of insulative material and including a cable-proximate face 42 having a groove 44 defined therealong that together with groove 30 of housing 20 contains cable 12 therewithin. Clamp member 40 may have mounting flanges 46 for being mounted to a panel or other structure. Opposed arms 48 extend upwardly along side edges 50 of clamp member 40 away from cable-remote face 52 and are shown to include mounting flanges 46 at leading ends thereof; arms 48 include slots 54 thereinto from the leading ends thereof for carrying an elongate actuator 80 extending therebetween. Shown extending between arms 48 is a shallow groove 56 serving as a detent cooperable with actuator 80 to maintain the actuator in an actuated position following cable termination.

Clamp member 40 and housing 20 are initially spaced apart sufficiently to define a cable-receiving region continuously therethrough and therebetween, so that the connector can be assembled to the cable at any location therealong. Clamp member 40 also includes several alignment posts 58 depending from cable-proximate face 42, receivable into post-receiving holes 32 of housing 20 during termination, to incrementally adjust the relative positions of clamp member 40 and housing 20 during initial stages of termination, as housing 20 is urged toward clamp member 40. Thus, groove 30 of housing 20 is coaligned with groove 44 of clamp member 40.

Elongate actuator 80 includes a central body section defining a cam 82 having an eccentric cross-section defining an eccentric portion 84 bearing against cable-remote face 52 of clamp member 40 between opposed arms 48, with cylindrical portions 86 disposed within slots 52 thereof and extending outwardly therebeyond. Ends 88 preferably have a hexagonal (or other polygonal) shaped cross-section facilitating engagement by standard tools such as wrenches for tool-assisted actuation resulting in termination of connector 10 to cable 12.

A pair of links 100 fasten housing 20 to actuator 80 when assembled just prior to cable termination, with clamp member 40 held securely therebetween. Each link 100 includes apertures 102,104 at respective ends thereof cooperable with a cylindrical portion 86 of actuator 80 and with an embossment 34 projecting from a side surface 36 of housing 20. Embossment 34 is shown to include an annular outwardly chamfered flange 38 at its end larger in diameter than aperture 102 of link 100 (such as by about 0.005 inches), to secure the link thereon after it is urged over the embossment with the flange compressing when passing through the link aperture due to the resilient nature of the material used, and subsequently resiling to define a stop surface outwardly of link 100. Similarly, an annular outwardly chamfered flange 90 larger in diameter than aperture 104 of the link, is defined between end 88 and cylindrical portion 86 of actuator 80 to secure the link thereon after it is urged over the end 88. The diameter of the link apertures should be incrementally larger than those of corresponding cylindrical portion 86 and embossment 34.

Figure 4:
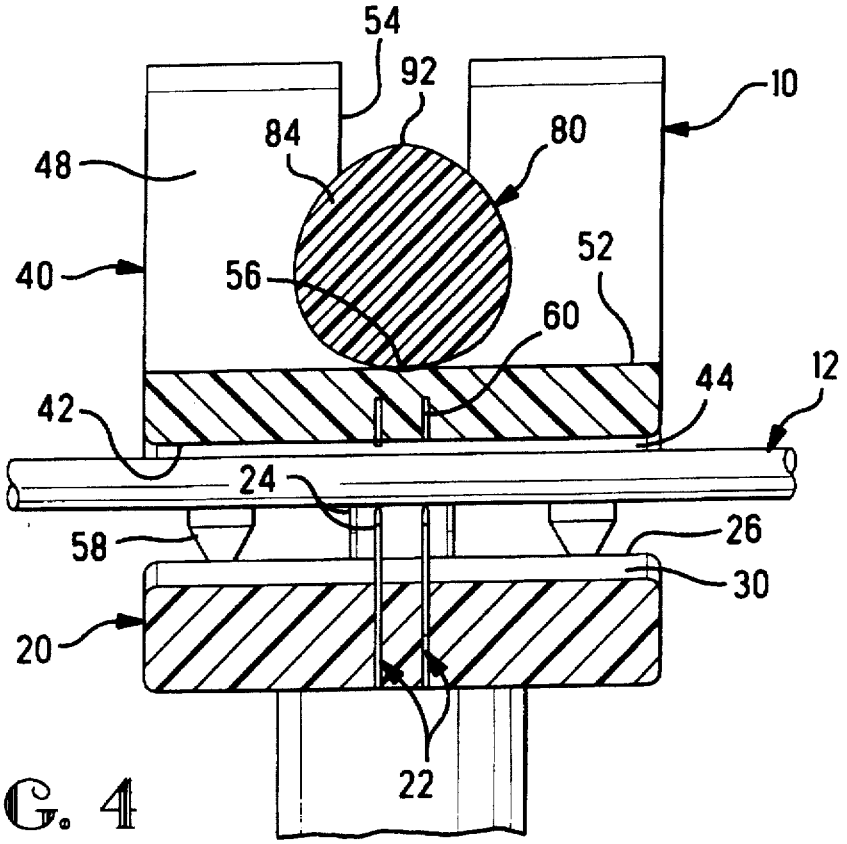
FIGS. 4 and 5 are longitudinal section views of the connector before and after cable termination.
Figure 6:
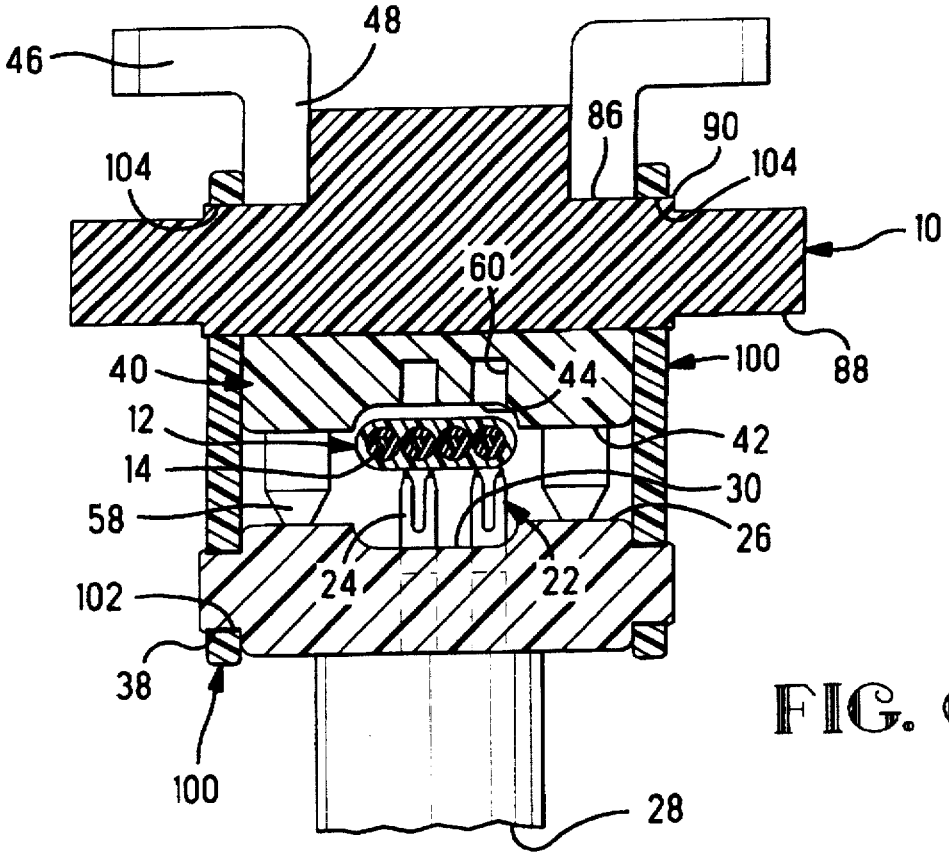
FIGS. 6 and 7 are cross-section views of the connector before and after cable termination.

With reference to FIGS. 2, 4 and 6, connector 10 is assembled about a midpoint of cable 12, with clamp member being mounted to a panel (not shown) between the cable and the panel in a manner aligning groove 44 with cable 12, with actuator 80 being cradled in slots 54 along cable-remote face 52 with eccentric portion 84 angularly offset from detent 56. Housing 20 is positioned adjacent to the cable with its groove 30 aligned with cable 12, and links 100 are assembled to both the clamp member and the housing by each being urged over an embossment 34 and an actuator end 86. Links 100 are just long enough so that cable 12 must seat within groove 44 of clamp member as sharply pointed leading ends of IDC contact sections 24 abut thereagainst when housing 20 is moved into position and affixed to clamp member 40 by links 100. When cable 12 is seated within groove 44, its conductors 14 are aligned with slots of the IDC contact sections 24 as necessary for successful cable termination.

Figure 5:
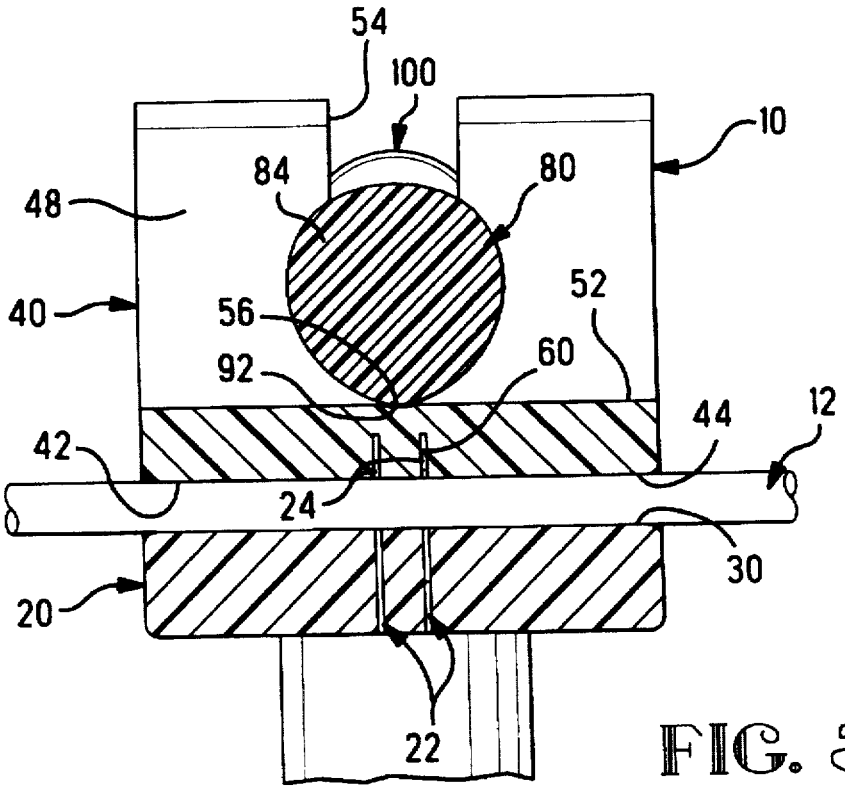
Figure 7:
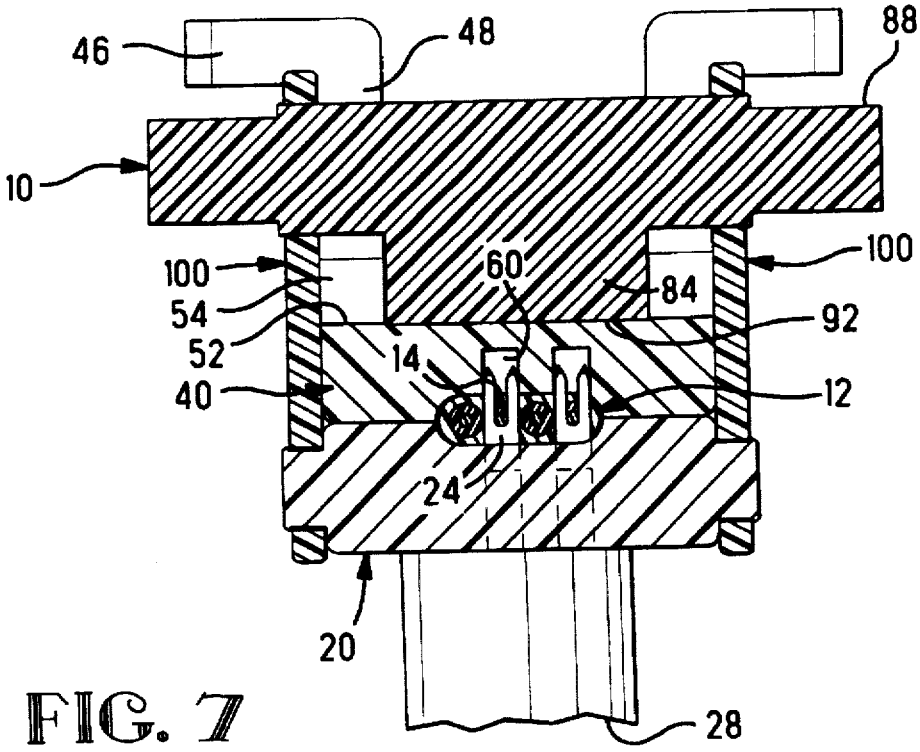

Upon actuation of actuator by tool-assisted rotation of actuator 80, eccentric cam portion 84 bears against cable-remote face 52 of clamp member 40 whereby actuator 80 is urged upwardly in slots 54 of arms 48, in turn pulling links 100 upwardly which results in housing 20 being urged toward clamp member 40 and cable 12. Pointed ends of the narrow beams of IDC contact sections 24 begin to penetrate the outer jacket 18 between conductors 14, and eventually conductors 14 enter the IDC slots so that sharp edges of the beams along the IDC slots penetrate the insulation layer of inner jacket 16 surrounding the respective conductors 14 and eventually establish compressive engagement with conductors 14 to define an assured electrical connection therewith. Cable-proximate face 42 of clamp member 40 includes slots 60 for receipt of pointed ends of the beams of the IDC contact sections 24 during final stages of termination, thus serving to support the beams during termination to assist in establishing and maintaining compressive engagement thereof with the cable conductors. Termination is complete when housing 20 is moved against clamp member 40, and peak 92 of eccentric portion 84 is seated within detent 56, as is seen in FIGS. 1, 5 and 7.

It is preferred that housing 20, clamp member 40, links 100 and actuator be molded of sturdy plastic material such as tough durable strong thermoplastic of moderate resilience, for example, DELRIN 100 acetal resin or nylon resin such as ZYTEL, both sold by E. I. DuPont de Nemours & Co. (Inc.), Wilmington, Del. It is also preferred that actuator 80 be so molded as to have coring to minimize any deformation of the bearing surface of eccentric portion 84 from shrinkage after molding, for example, coring may be utilized in sides of the cam section at least 60 degrees to either side of peak 92, and may extend most of the length of the central region of the cam between arms 48 but leaving spaced apart circumferentially continuous portions of the cam to maintain appropriate cam engagement with cable-remote surface 52.

It is seen that connector 10 completely surrounds the terminations to the conductor of the cable, thus assuring that the tap is completely insulated as is necessary for safety reasons. It is preferred that the height of the cable receiving region defined by grooves 30, 44 be incrementally less than the minimum vertical thickness of the cable in order to assure compression of the cable upon full termination to assure complete insulation of any exposed metal at the terminations of contacts 22 with conductors 14. Further it is preferred that the links are under tension in the fully actuated condition of connector 10 to assure compression of the cable in grooves 30, 44. Preferably, rotation of the actuator begins to stress links 100 at ±5 degrees from the fully actuated position, accomplished by enlarging the distance of the cam's outer surface at eccentric peak 92 with respect to the axis of rotation, to an extend larger than the allowable travel distance of the housing toward the clamp member, for an angular distance of 10 degrees. Detent 56 may for example have a depth of 0.005 inches, a width of 0.084 inches and a radius of 0.1789 inches. As is desirable, an audible indication is generated as the eccentric peak 92 of cam 82 enters and seats within detent 56 signifying full actuation.

Although it is preferred to provide actuator 90 with tool-engageable end portions 88 at both ends to allow actuation from either end depending on any constrictions in the surroundings of the site of connector application in the premises, such as within a machine, the actuator may be modified to provide only one such tool-engageable portion. The actuator could also be modified to allow cam rotation in only one direction between unactuated and actuated positions, although rotation of the cam in both directions allows greater facility in termination. Variations and modifications may occur that are within the spirit of the invention and the scope of the claims.

What is claimed is:

1. An electrical connector assembly for use in tapping a power cable, comprising:

an insulative housing having a plurality of contacts therewithin, a clamp member, fastening members for fastening said housing to said clamp member, and an actuator for terminating the assembly to the power cable upon actuation thereof;

said plurality of contacts each associated with a respective conductor of the power cable and having an insulation displacement contact section so positioned in said housing to be aligned with a respective said conductor during application of the assembly to the cable;

said housing and said clamp member spaced apart to define a cable-receiving region extending continuously therethrough and therebetween and initially being separated sufficiently to be assembled around the cable at a selected location therealong for tapping, and including a cooperating alignment arrangement assuring that they are actuated to move toward and to each other in a precisely guided manner, and further including cable-positioning sections to secure the cable in a selected position with respect to said insulation displacement contact sections to permit termination thereby during actuation of said actuator; and said fastening members so affixed to the assembly as to permit translation of said clamp relatively toward said housing during application of the assembly to the cable.

2. The connector assembly as set forth in claim 1 wherein said clamp member includes mounting sections for panel mounting.

3. The connector assembly as set forth in claim 1 wherein a cable-proximate face of said clamp member includes a cable-receiving groove defined therealong.

4. The connector assembly as set forth in claim 1 wherein a cable-proximate face of said housing includes a cable-receiving groove defined therealong.

5. The connector assembly as set forth in claim 1 wherein said cooperating alignment arrangement comprises a plurality of alignment posts on either one of said housing and said clamp member, and a corresponding plurality of post-receiving holes in the other thereof.

6. The connector assembly as set forth in claim 1 wherein said actuator is secured in said assembly adjacent said clamp member.

7. The connector assembly as set forth in claim 6 wherein said clamp member includes opposed arms extending from sides of a cable remote face thereof, and said arms including slots for holding said actuator therebetween.

8. The connector assembly as set forth in claim 7 wherein said actuator includes portions extending outwardly beyond said arms at least one of said portions concluding in a tool-engageable end portion.

9. The connector assembly as set forth in claim 8 wherein both said portions conclude in tool-engageable end portions, enabling actuation at either end.

10. The connector assembly as set forth in claim 8 wherein said fasteners are a pair of links securable to respective sides of said housing and said outwardly extending portions of said actuator after said clamp member and said housing are positioned adjacent each other about a length of the cable prior to termination.

11. The connector assembly as set forth in claim 10 wherein each of said links includes an aperture at each end with one of said apertures adapted to be urged onto a respective said outwardly extending portion of said actuator for becoming fastened thereto, and another of said apertures adapted to be urged onto a respective embossment extending outwardly from said side of said housing for becoming fastened thereto.

12. The connector assembly as set forth in claim 11 wherein said actuator is rotatable within said slots and includes a cam portion between said opposed arms and having an eccentric portion bearable against said cable-remote face of said clamp member between an unactuated position and an actuated position, with said actuator movable away from said cable-remote face upon actuation to carry said links and urge said housing toward and against said clamp member, terminating said cable.

13. The connector assembly as set forth in claim 12 wherein said actuator and a said clamp member are adapted that said actuator is rotatable in either direction to attain said actuated position.

14. The connector assembly as set forth in claim 12 wherein said cable-remote face of said clamp member includes a detent cooperable with a peak of said eccentric portion of said actuator to maintain said eccentric portion therein upon full actuation of said actuator and maintain said assembly in a terminated state with respect to said cable.

15. The connector assembly as set forth in claim 12 wherein said links are under tension in a fully actuated position.

16. The connector assembly as set forth in claim 15 wherein said housing and said clamp member are adapted to compress said cable in said fully actuated position.

* * * * *